US005812902A

United States Patent [19]

Lee

[11] Patent Number: 5,812,902

[45] Date of Patent: Sep. 22, 1998

[54] DEVICE AND METHOD FOR DISPLAYING AN EXCHANGE MESSAGE FOR A PROCESS CARTRIDGE IN AN IMAGE FORMING APPARATUS

[75] Inventor: Dong-Ho Lee, Suwon, Rep. of Korea

[73] Assignee: SamSung Electronics Co., Ltd., Suwon, Rep. of Korea

[21] Appl. No.: 555,749

[22] Filed: Nov. 9, 1995

[30] Foreign Application Priority Data

Nov. 10, 1994 [KR] Rep. of Korea ..... 29453/1994

[51] Int. Cl.[6] ..... G03G 21/02

[52] U.S. Cl. ..... 399/25; 399/43; 399/10

[58] Field of Search ..... 355/210, 211, 355/200, 245; 399/25, 43, 111, 10

[56] References Cited

U.S. PATENT DOCUMENTS

| | | | |
|---|---|---|---|
| 4,462,677 | 7/1984 | Onoda . | |
| 4,470,689 | 9/1984 | Nomura et al. . | |
| 4,496,237 | 1/1985 | Schron . | |
| 4,538,896 | 9/1985 | Tajima et al. . | |
| 4,551,000 | 11/1985 | Kanemitsu et al. . | |
| 4,588,280 | 5/1986 | Ogawa et al. . | |
| 4,851,875 | 7/1989 | Tanimoto | 355/245 |
| 4,873,549 | 10/1989 | Tada et al. | 355/206 |
| 4,961,088 | 10/1990 | Gilliland et al. | 355/206 |
| 5,008,711 | 4/1991 | Sakamoto et al. . | |
| 5,066,978 | 11/1991 | Watarai et al. | 355/206 |
| 5,101,233 | 3/1992 | Ito et al. | 355/209 |
| 5,115,275 | 5/1992 | Suzuki | 355/245 |
| 5,155,527 | 10/1992 | Gokita et al. | 355/204 |
| 5,294,960 | 3/1994 | Nomura et al. | 355/210 |
| 5,489,971 | 2/1996 | Nam . | |

*Primary Examiner*—R. L. Moses
*Attorney, Agent, or Firm*—Robert E. Bushnell, Esq.

[57] ABSTRACT

A device for displaying an exchange message for a process cartridge installed within a body of an image forming apparatus informs a user when the process cartridge should be replaced. The process cartridge, which can be installed within and removed from the body, combines a photosensitive drum, a cleaning blade and a waste toner receptacle as a unitary structure. A display provides the user with predetermined messages. A video controller receives a print command from a host computer and controls a printing operation by increasing an internally stored sheet printing index value by one in response to each printed sheet, and enables output of a message indicating that the process cartridge should be exchanged through the display when the sheet printing index value is greater than a predetermined value.

18 Claims, 6 Drawing Sheets

DEVICE AND METHOD FOR DISPLAYING AN EXCHANGE MESSAGE FOR A PROCESS CARTRIDGE IN AN IMAGE FORMING APPARATUS

CROSS-REFERENCE TO RELATED APPLICATIONS

This application makes reference to, incorporates the same herein, and claims all benefits accruing under 35 U.S.C. §119 from an application for Device And Method For Displaying An Exchange Message For A Process Cartridge In An Image Forming Apparatus earlier filed in the Korean Industrial Property Office on 10 Nov. 1994 and there assigned Ser. No. 29453/1994.

BACKGROUND OF THE INVENTION

The present invention relates to an image forming apparatus, and more particularly to a device and method for displaying an exchange message for a process cartridge in an image forming apparatus.

A process cartridge is provided to unite a charging device, a luminous exposure device, and a developing device in the image forming apparatus using an electrophotographic developing process such as a copying machine, a laser printer and a facsimile for plain paper.

One example of the process cartridge is disclosed in U.S. Pat. No. 3,985,436. U.S. Pat. No.3,985,436 is characterized in that a photosensitive drum, a cleaner and a developing device are united as a single cartridge, thereby making it possible to exchange the process cartridge with a new one when some expendable portion(s) of the cartridge, such as the photosensitive drum or toner, need to be exchanged or replaced. Other examples of the process cartridge are disclosed in U.S. Pat. Nos. 4,538,896, 4,588,280, 4,462,677, and 4,470,689. Still other examples are disclosed in Korean patent application No. 92-23941 and German patent application No. 41 38 079.7-51, which were filed by the same applicant as the present invention. While the conventional process cartridges cited above provide a user with the ability to exchange an expended process cartridge with a new process cartridge, I note that the conventional art can be improved upon to provide the user with an accurate indication as to when the process cartridge should be replaced.

SUMMARY OF THE INVENTION

Accordingly, it is an object of the invention to provide a device and method for providing an exchange message for a process cartridge in an image forming apparatus.

It is another object to provide a process cartridge capable of preventing contamination of an image forming apparatus attributable to waste toner.

It is still another object to provide a process cartridge capable of being manufactured for a relatively low price.

These and other objects can be achieved according to the principles of the present invention with a device and method for displaying the exchange message for a process cartridge installed within a body of an image forming apparatus. The process cartridge, which can be installed within and removed from the body, combines a photosensitive drum, a cleaning blade and a waste toner receptacle as a unitary structure. A display provides the user with predetermined messages. A video controller receives a print command from a host computer and controls a printing operation by increasing an internally stored sheet printing index value by one in response to each printed sheet, and enables output of a message indicating that the process cartridge should be exchanged through the display when the sheet printing index value is greater than a predetermined value. A method according to an exemplary embodiment of the present invention comprises the steps of increasing the sheet printing index value by one in response to each printed sheet, increasing an initial value stored within the process cartridge by one when the sheet printing index value exceeds a predetermined value, enabling output of the message indicating that the process cartridge should be exchanged through the display when the sheet printing index value is greater than the predetermined value, and initializing the sheet printing index value when the initial value stored within the process cartridge indicates that the process cartridge has been exchanged for a new process cartridge.

BRIEF DESCRIPTION OF THE DRAWINGS

A more complete appreciation of the present invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
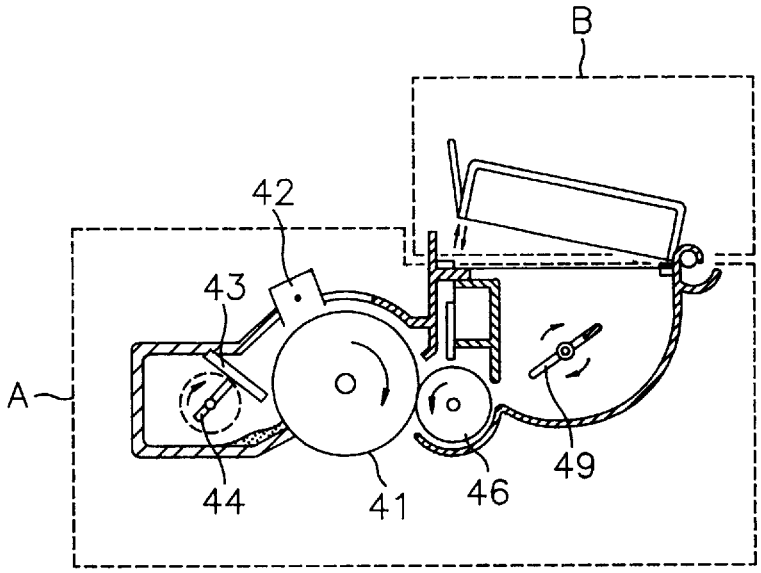
FIG. 1 is a cross-sectional view illustrating the construction of a conventional process cartridge and toner cartridge.

Turning now to the drawings and referring to FIG. 1, a cross-sectional view of a toner cartridge attachable to a process cartridge, as disclosed in Korean patent application No. 92-23941, is shown. FIG. 1 is comprised of process cartridge A, and toner cartridge B which can be attached to and detached from process cartridge A. Process cartridge A is a housing wherein a photosensitive drum 41, a charging unit 42, a cleaning blade 43, a waste toner transporting wing 44, and a developing unit having a developing roller 46 and a toner agitating wing 49 are united into a unitary body. Process cartridge A of FIG. 1 has been determined to cause a toner contamination problem attributable to waste toner being discharged to an exterior of the apparatus by the operation of waste toner transporting wing 44. Since toner contamination poses a serious problem in the image forming apparatus, it is imperative that this issue be addressed.

In the detailed description that follows, several specific circuit elements are provided for a comprehensive understanding of the present invention. These specific elements are not intended to be limiting in any manner. Accordingly, it is evident that a person having ordinary skill in the relevant art can carry out the present invention without the specific elements that are disclosed. Moreover, a description of well-known elements has been omitted so as not to obscure the present invention.

Figure 2:
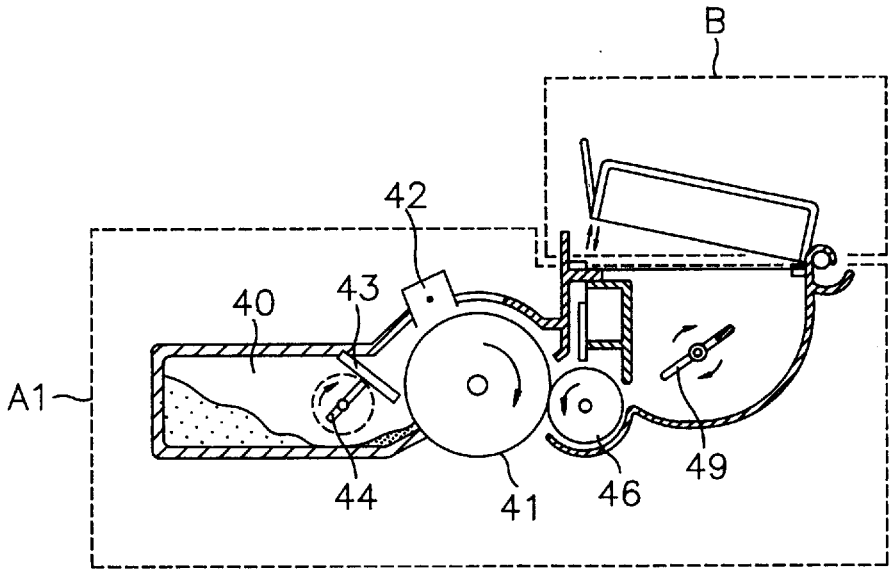
FIG. 2 is a cross-sectional view illustrating a process cartridge and a toner cartridge constructed according to a first embodiment of the present invention.
Figure 10:
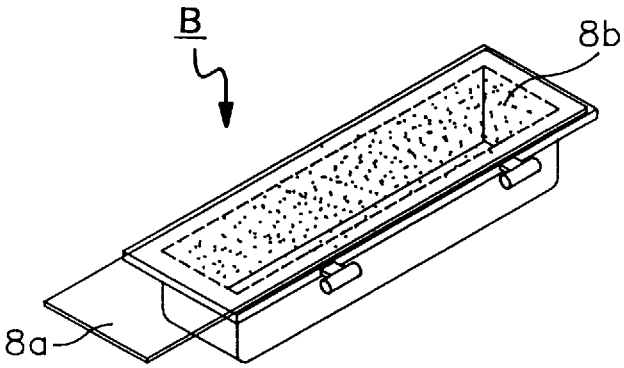
FIG. 10 is a view illustrating an example of the toner cartridge embodied in the present invention.

Referring now to FIG. 2, a cross-sectional view of a process cartridge and a toner cartridge constructed according to a first embodiment of the present invention is shown. In FIG. 2, a process cartridge A1 includes a toner waste receptacle 40, a photosensitive drum 41, a charging unit 42, a cleaning blade 43, a waste toner transporting wing 44, and a developing unit having a developing roller 46 and a toner agitating wing 49, which are united as a unitary body. A toner cartridge B is attachable to and or detachable from process cartridge A1. As shown in FIG. 2, process cartridge A1 provides toner waste to receptacle 40 so that waste toner is not discharged to an exterior of the apparatus, thereby solving the toner contamination problem. Toner cartridge B is illustrated in more detail in FIG. 10, and includes an adhesive film 8*a* and toner 8*b*.

Figure 3:
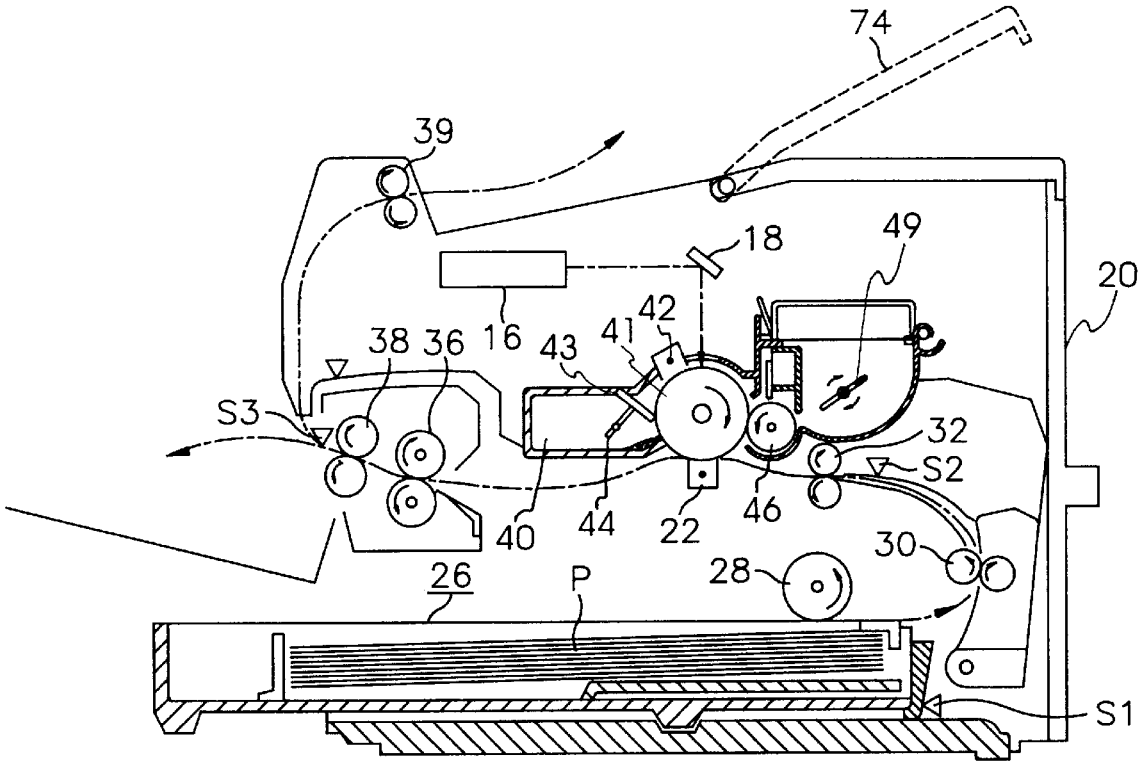
FIG. 3 is a cross-sectional view illustrating a laser beam printer in which the process cartridge and toner cartridge of FIG. 2 are installed.

FIG. 3 is a cross-sectional view illustrating a laser beam printer in which process cartridge A1 and toner cartridge B of FIG. 2 are installed. Process cartridge A1 is installed within a body 20 of the laser beam printer after a cover 74 of body 20 of the laser beam printer is opened. Thus, if the exchange period of an expendable item, such as photosensitive drum 41, is terminated, cover 74 of body 20 is opened and the exhausted process cartridge is removed and exchanged with a new process cartridge. In the case of utilizing an organic photo conductor (OPC) for photosensitive drum 41, about 15,000 to 20,000 sheets can be printed. Toner cartridge B, which is constructed so that it can be attached to or detached from process cartridge A1, has an exchange period determined by an internal toner storage capacity. In general, toner cartridge B contains enough toner to print about 3,000 sheets. The laser beam printer of FIG. 3 further includes a paper cassette 26 for storing sheets of paper P. A first sensor S1 senses the installation of paper cassette 26 within body 20 of the laser beam printer, and a pick-up roller 28 extracts paper P from paper cassette 26. A first set of register rollers 30 and a second set of register rollers 32 receive and arrange paper P provided by pick-up roller 28, while a second sensor S2 senses paper P as it passes between the first set of register rollers 30 and the second set of register rollers 32. An exposing unit 16 exposes photosensitive drum 41 with light through reflecting means 18 and a transfer unit 22 transfers toner onto paper P as it passes between transfer unit 22 and photosensitive drum 41. Fixing rollers 36 secure the toner upon paper P. A first set of delivery rollers 38 receive paper P from fixing rollers 36 and deliver the paper P past a third sensor S3 to either a first exit on the side of the laser beam printer, or to a second exit on the top of the laser beam printer via a second set of delivery rollers 39.

Figure 4:
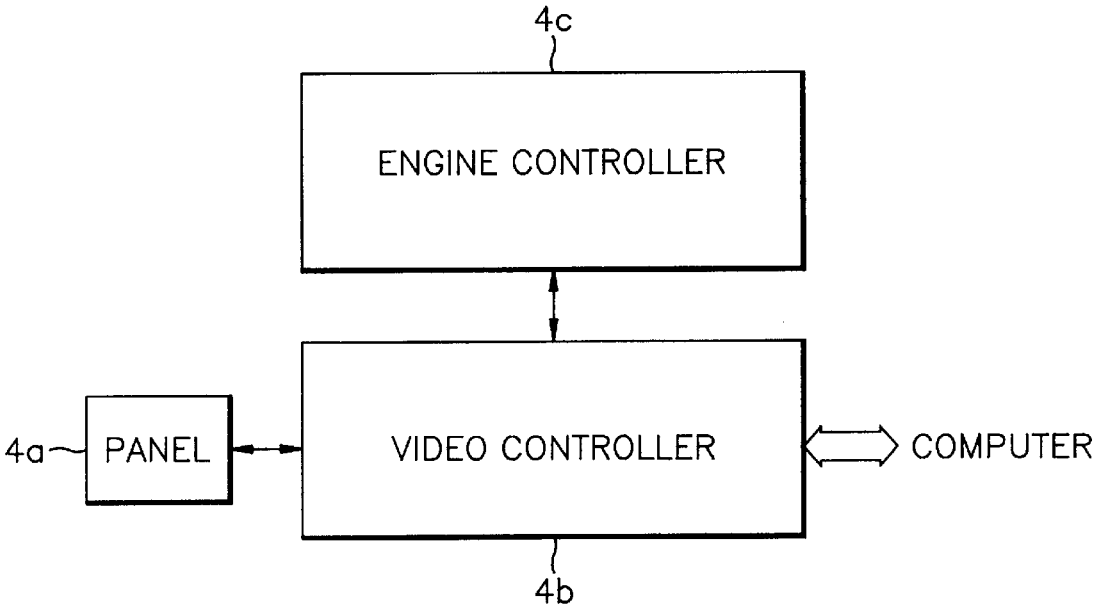
FIG. 4 is a block diagram illustrating a portion of a laser beam printer constructed according to the first embodiment of the present invention.

FIG. 4 is a block diagram illustrating a portion of the laser beam printer constructed according to the first embodiment of the present invention. The laser beam printer has a known construction comprising an engine portion having a printing apparatus (not shown) and an engine controller 4*c*, and a video controller 4*b* for receiving various control data associated with printing from a panel 4*a* and print data from a computer. Video controller 4*b* converts the control data and print data to bit map data (i.e., video data) before delivering the data to engine controller 4*c*. Engine controller 4*c* and video controller 4*b* are respectively comprised of a central processing unit (CPU), a read only memory (ROM) and a random access memory (RAM), namely a nonvolatile RAM (NVRAM) for storing the number of printed sheets that have been generated.

Figure 5:
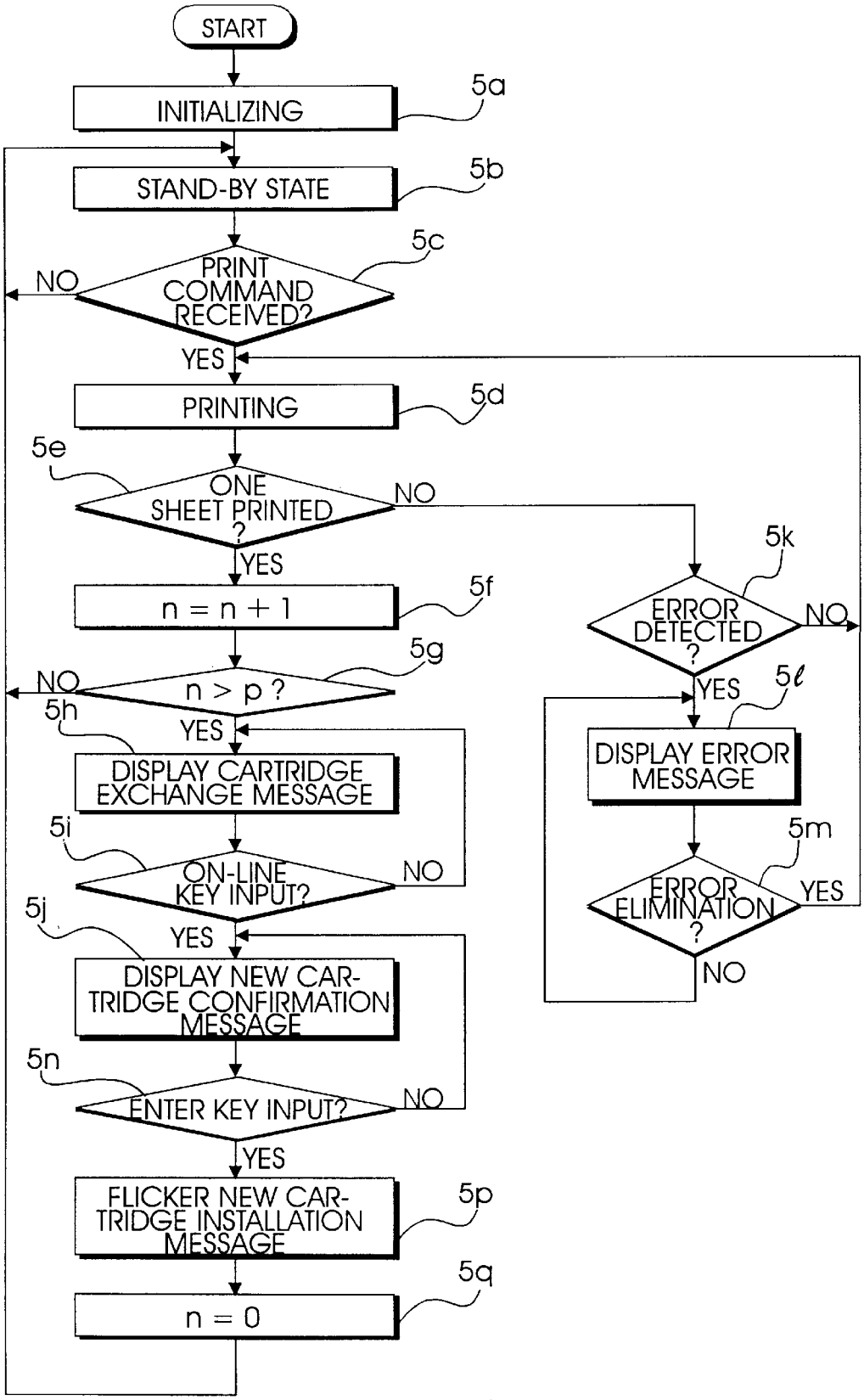
FIG. 5 is a flow chart illustrating a method for displaying an exchange message for a process cartridge according to the first embodiment of the present invention.

FIG. 5 is a flow chart illustrating a method for displaying an exchange message for the process cartridge constructed according to the first embodiment of the present invention. With reference to FIGS. 2 through 5, the operational steps of the method will now be described.

After an initializing operation in step 5*a*, and activation of a stand-by state in step 5*b*, the image forming apparatus detects receipt of a print command from the host computer in step 5*c*. In response to the print command, one sheet of paper is picked up pursuant to control of engine controller 4*c* and the paper is arranged by register rollers 30 and 32. Then, electrophotographic printing procedures including development, transfer, and cleaning are performed in step 5*d*. When one sheet is determined to have been printed in step 5*e*, a sheet printing index value n stored in the nonvolatile memory of video controller 4*b* representing the number of printed sheets that have been generated by the presently installed process cartridge is incremented by one in step 5*f*. At this time, if the sheet printing index value n is greater than a predetermined number p in step 5*g*, a message indicating that the process cartridge should be exchanged is displayed on a liquid crystal display (LCD) of panel 4*a* in step 5*h*. The user recognizes the cartridge exchange message and then replaces the expended process cartridge with a new process cartridge. If an on-line key is input by the user in step 5*i*, a message confirming whether or not the expended process cartridge has been exchanged for a new one is displayed on panel 4*a* pursuant to the control of the central processing unit (CPU) in step 5*j*. Thereafter, the user inputs an enter key to confirm that the expended process cartridge has been exchanged for a new one in step 5*n*. The central processing unit (CPU) is then controlled so that a message indicating that a new process cartridge has been installed is flickered on panel 4*a* in step 5*p*, and the sheet printing index value n stored in the nonvolatile memory of video controller 4*b* is initialized to zero in step 5*q*. The image forming apparatus then proceeds to the stand-by state in step 5*b*. The method of FIG. 5 further provides a printing error detection operation in step 5*k*, an error message display operation in step 51, and an error elimination detection operation in step 5*m*.

After the message indicating that the process cartridge should be exchanged is displayed, the image forming apparatus may continue to be operated, but preferably is not operated until the expended process cartridge is exchanged with a new process cartridge. In other words, even though the process cartridge exchange message is displayed, the print command can still be received from the computer.

In the first embodiment of the present invention described above, as compared to the conventional method performed by the device shown in FIG. 1, waste toner contamination is substantially prevented by combining waste toner receptacle 40 with process cartridge A1. Moreover, in cases where the process cartridge is used excessively, a problem affecting normal operation of the apparatus may arise in that waste toner receptacle 40 becomes overly full. This problem can be eliminated with the present invention, however, by displaying the process cartridge exchange message.

With the first embodiment of the present invention, however, if user inputs the enter key in step 5*n* without actually replacing the expended process cartridge with a new one, some problems can arise. These problems are addressed and resolved by a second embodiment of the present invention.

Figure 6:
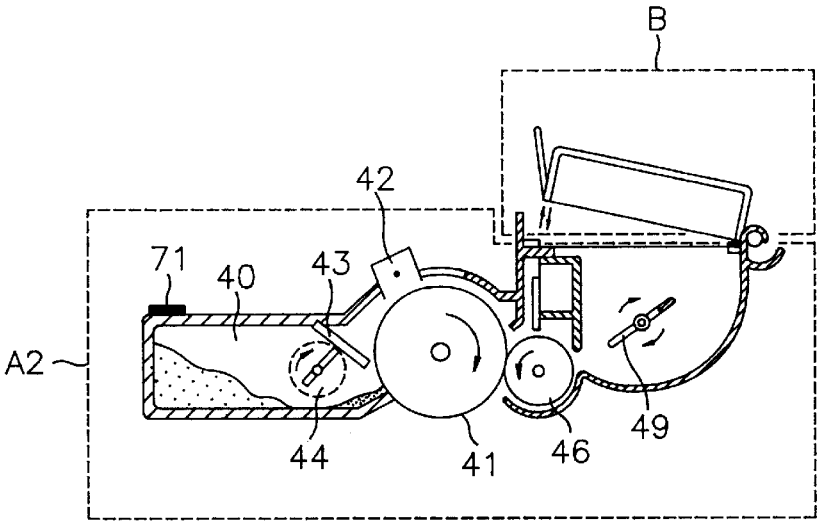
FIG. 6 is a cross-sectional view illustrating the construction of a process cartridge and a toner cartridge constructed according to a second embodiment of the present invention.
Figure 7:
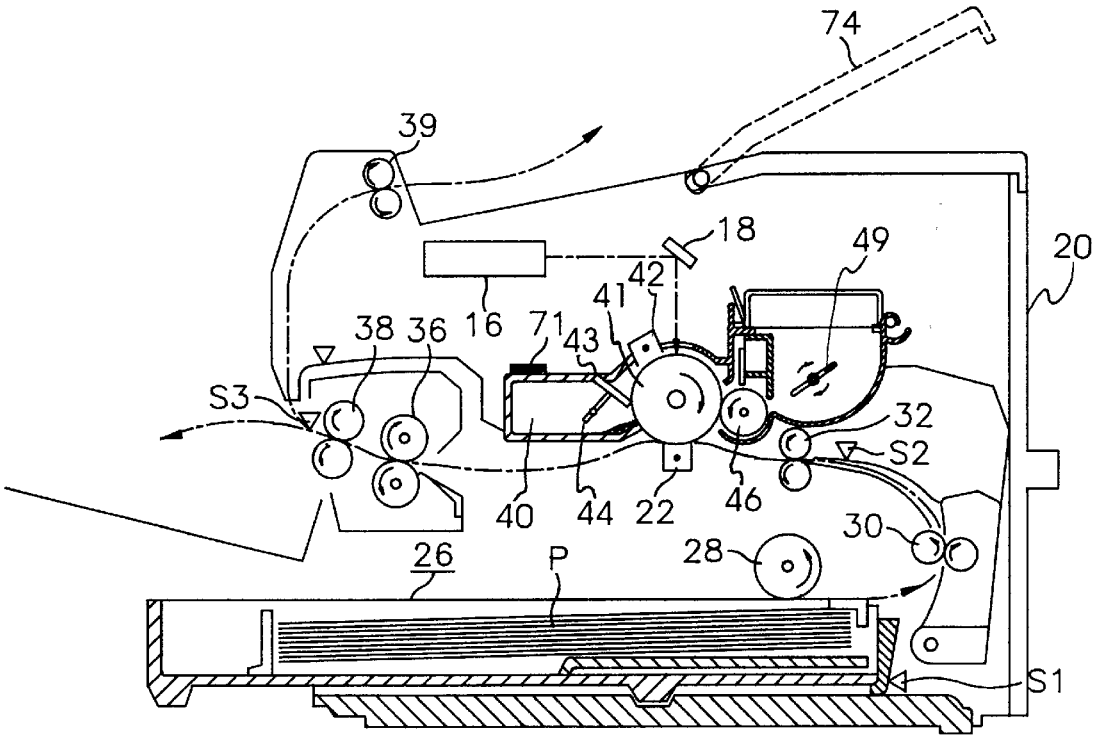
FIG. 7 is a cross-sectional view illustrating a laser beam printer in which the process cartridge and toner cartridge of FIG. 6 are installed.

The process cartridge constructed according to the second embodiment of the present invention is shown in FIG. 6. The process cartridge A2 shown in FIG. 6 is essentially the same as the one shown in FIG. 2, except that it further includes a process cartridge memory 71. FIG. 7 is a cross-sectional view illustrating a laser beam printer in which process cartridge A2 and toner cartridge B of FIG. 6 are installed. The laser beam printer of FIG. 7 uses the same reference numbers as FIG. 3 to represent like elements.

Figure 8:
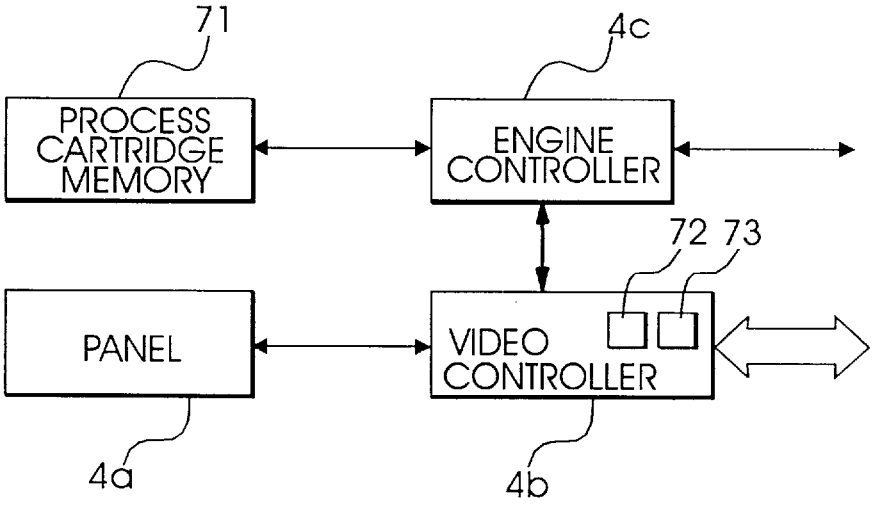
FIG. 8 is a block diagram illustrating a portion of a laser beam printer constructed according to the second embodiment of the present invention.

FIG. 8 is a block diagram illustrating portions of the laser beam printer depicted in FIG. 7, according to the second embodiment of the present invention. The block diagram of FIG. 8 is essentially the same as the block diagram of FIG. 4, except that it further includes process cartridge memory 71 and video controller 4*b* utilizes two distinct memories 72 and 73.

Figure 9:
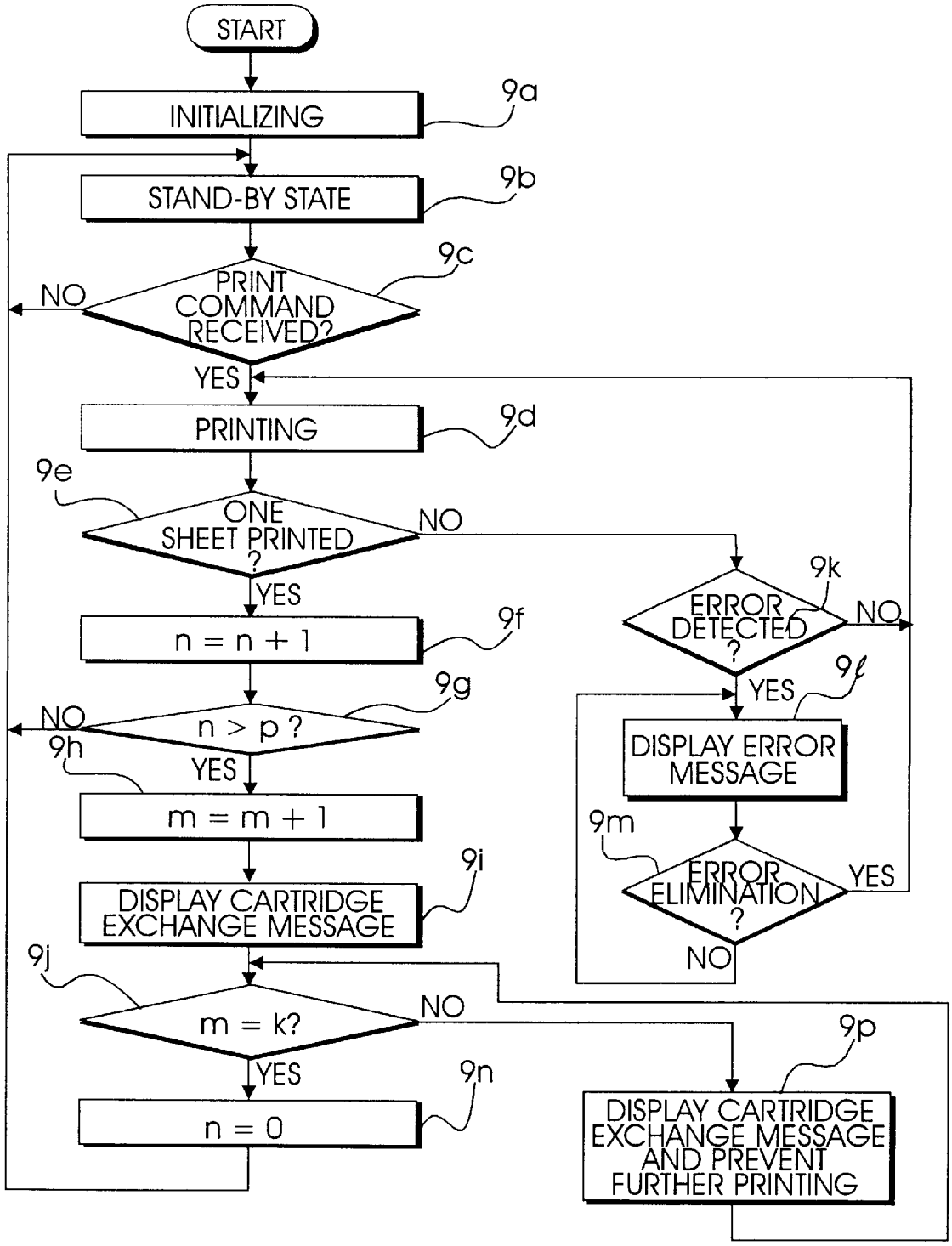
FIG. 9 is a flow chart illustrating a method for displaying an exchange message for the process cartridge constructed according to the second embodiment of the present invention.

FIG. 9 is a flow chart illustrating a method for displaying the exchange message for the process cartridge constructed according to the second embodiment of the present invention. With reference to FIGS. 6 through 9, the operational steps of the method will now be described.

After an initializing operation in step 9*a*, and activation of a stand-by state in step 9*b*, the image forming apparatus detects receipt of a print command from the host computer in step 9*c*. In response to the print command, one sheet of paper is picked up pursuant to control of engine controller 4*c* and the paper is arranged by register rollers 30 and 32. Then, electrophotographic printing procedures including development, transfer, and cleaning are performed in step 9*d*. When one sheet is determined to have been printed in step 9*e*, a sheet printing index value n stored in the non-volatile memory 72 of video controller 4*b* representing the number of printed sheets that have been generated by the presently installed process cartridge is incremented by one in step 9*f*. At this time, if the sheet printing index value n is greater than a predetermined value p in step 9*g*, an initial value m which was stored upon production in process cartridge memory 71 is incremented by one in step 9*h*. Therefore, the value m stored in process cartridge memory 71 of an expended process cartridge A2 is larger than the initial value of m by one. Accordingly, it can be appreciated that the value m stored in process cartridge memory 71 indicates whether or not process cartridge A2 is expended.

Next, the message indicating that the process cartridge should be exchanged is displayed on the liquid crystal display (LCD) of panel 4*a* in step 9*i*. In step 9*j*, it is determined whether the value m stored in the presently installed process cartridge memory 71 is equal to a value k stored in another memory 73 of video controller 4*b*. At this time, if the user has not exchanged the process cartridge, the message indicating that the process cartridge should be exchanged is continuously displayed and further printing is prohibited in step 9*p*. However, if the user exchanges the expended process cartridge for a new process cartridge in response to the cartridge exchange message displayed in step 9*i*, video controller 4*b* reads the value m stored in the process cartridge memory 71 of the new process cartridge, and recognizes that the expended process cartridge has been replaced with a new process cartridge since the value m is equal to the value k (e.g., m and k equal 0). Video controller 4*b* then initializes the sheet printing index value n stored in memory 72 in step 9*n*, and proceeds back to step 9*b*.

Accordingly, the problem arising in the first embodiment of the present invention where the user inputs the enter key despite having not installed a new process cartridge can be eliminated by the second embodiment of the present invention.

As set forth above, the present invention provides a device for displaying an exchange message for a process cartridge installed within a body of an image forming apparatus. The process cartridge, which can be installed within and removed from the body, combines a photosensitive drum, a cleaning blade and a waste toner receptacle as a unitary structure. A display provides the user with predetermined messages. A video controller receives a print command from a host computer and controls a printing operation by increasing an internally stored sheet printing index value by one in response to each printed sheet, and enables output of a message indicating that the process cartridge should be exchanged through the display when the sheet printing index value is greater than a predetermined value.

While there have been illustrated and described what are considered to be preferred embodiments of the present invention, it will be understood by those skilled in the art that various changes and modifications may be made, and equivalents may be substituted for elements thereof without departing from the true scope of the present invention. In particular, the laser beam printer is illustrated in the embodiments of the present invention, but the present invention can also be applied to any image forming apparatus that utilizes a replaceable process cartridge as described above. Therefore, the true scope of the present invention should not be determined by the above described embodiments, but by the appended claims and equivalents thereof.

What's claimed is:

1. A method for displaying an exchange message for a process cartridge, comprising:

responding to a print command requesting formation of images onto one or more sheets of a printable media by a process cartridge installed with a body of an image forming apparatus, said process cartridge having a photosensitive drum, a cleaning blade and a waste toner receptacle combined as a unitary structure, said unitary structure capable of being installed within or removed from said body of said image forming apparatus, comprising the steps of:

incrementing a sheet printing index value representative of a number of printed sheets that have been generated by said process cartridge by one after each one of said printed sheets is generated by said process cartridge, said sheet printing index value being stored within a video controller of said image forming apparatus;

incrementing a first value stored within said process cartridge by one when said sheet printing index value exceeds a predetermined value;

displaying, via display means, said exchange message indicating that said process cartridge should; be exchanged for a new process cartridge when said sheet printing index value exceeds said predetermined value; and comparing said first value with a second value stored within said video controller, and preventing a printing operation while continuing to display said exchange message when said first value and said second value lack a particular relation.

2. A device for displaying an exchange message for a process cartridge installed within a body of an image forming apparatus, said device comprising:

a process cartridge comprising a photosensitive drum, a cleaning blade and a waste toner receptacle combined as a unitary structure, said unitary structure being installed within and removed from said body of said image forming apparatus;

display means for visually displaying various predetermined messages; and a controller receiving a print command from a host computer and controlling printing operations performed by said image forming apparatus, said controller storing a sheet printing index value representative of a number of printed sheets that have been generated by said process cartridge and incrementing said sheet printing index value by one after each one of said printed sheets is generated by said process cartridge, said controller enabling said display means to display said exchange message indicating that said process cartridge should be exchanged for a new process cartridge and initiating an inquiry soliciting confirmation that said process cartridge has been replaced after said display of said exchange message while controlling further printing operations when said sheet printing index value reaches said predetermined value, said controller initiating said inquiry by:

determining whether said image forming apparatus has received any key input from a user after said display of said exchange message;

enabling said display means to broadcast a subsequent message after determining that said image forming apparatus has received key input after said display of said exchange message; and determining whether said image forming apparatus has received any key input from the user after said broadcast of said subsequent message; and after said inquiry, setting said sheet printing index value to an initial value indicating that said process cartridge had been replaced and enabling said further printing operations after determining that said image forming apparatus has received key input from the user after said broadcast of said subsequent message.

3. The device as claimed in claim 2, wherein said sheet printing index value is reset to said initial value when said controller determines that said process cartridge has been exchanged for a new process cartridge.

4. A device for displaying an exchange message for a process cartridge installed within a body of an forming apparatus, said device comprising:

a process cartridge comprising a photosensitive drum, a cleaning blade and a waste toner receptacle combined as a unitary structure, said unitary structure being installed within and removed from said body of said image forming apparatus;

a first memory operationally mounted on said process cartridge, storing an initial value representing that said sheet printing index value has not reached said predetermined value while said process cartridge has been installed within said image forming apparatus;

display means for visually displaying various predetermined messages; and a controller receiving a print command from a host computer and controlling printing operations performed by said image forming apparatus, said controller storing a sheet printing index value representative of a number of printed sheets that have been generated by said process cartridge and incrementing said sheet printing index value by one after each one of said printed sheets is generated by said process cartridge, said controller enabling said display means to display said exchange message indicating that said process cartridge should be exchanged for a new process cartridge and initiating an inquiry soliciting confirmation that said process cartridge has been replaced after said display of said exchange message while controlling further printing operations when said sheet printing index value reaches said predetermined value, said controller initiating said inquiry by:

said controller changing said initial value to a different value when said sheet printing index value reaches said predetermined value and, after enabling said display means to display said exchange message, initiating said inquiry by:

determining whether any memory borne by any said process cartridge currently installed within said image forming device is storing said initial value; and resetting said sheet printing value to a preliminary value indicating replacement of said process cartridge with a second cartridge after said display of said exchange message and after determining that a second memory borne by said second cartridge currently installed within said image forming device is storing said initial value; and enabling said further printing operation after said resetting.

5. A device for displaying an exchange message for a process cartridge installed within a body an image forming apparatus, said device comprising:

said process cartridge comprising a first memory for storing a first initial value, a photosensitive drum, a cleaning blade and a waste toner receptacle combined as a unitary structure, said unitary structure being installed within and removed from said body of said image forming apparatus;

display means for displaying predetermined messages; and a controller comprising a second memory for storing a second initial value and a sheet printing index value representative of a number of printed sheets that have been discharged by said process cartridge, said controller incrementing said sheet printing index value by one when each one of said printed sheets is discharged by said process cartridge, said controller incrementing said first initial value stored in said first memory by one and enabling said display means to display said exchange message indicating that said process cartridge should be exchanged for a new process cartridge when said sheet printing index value exceeds a predetermined value, said controller then enabling a printing operation to be performed when said first initial value stored in said first memory equals said second initial value stored in said second memory.

6. The device as claimed in claim 5, wherein said controller prevents said printing operation from being performed when said first initial value stored in said first memory is not equal to said second initial value stored in said second memory.

7. The device as claimed in claim 5, wherein said controller enables said printing operation to be performed after said controller determines that said first initial value stored in said first memory equals said second initial value stored in said second memory.

8. The device as claimed in claim 6, wherein said controller enables said printing operation to be performed after said controller determines that said first initial value stored in said first memory equals said second initial value stored in said second memory.

9. A method for displaying an exchange message for a process cartridge, comprising:

responding to a print command requesting formation of images onto one or more sheets of a printable media by the process cartridge installed within a body of an image forming apparatus said process cartridge having a first memory operationally mounted on the process cartridge and storing a first value, a photosensitive drum, a cleaning blade and a waste toner receptacle combined with said process cartridge as a unitary structure capable of being installed within and removed from said body, display means for displaying predetermined messages, a second memory for storing a second value and a third memory for storing a sheet printing index value;

incrementing said sheet printing index value representative of a number of printed sheets that have been generated by said process cartridge by one after each one of said printed sheets is generated by said process cartridge;

incrementing said first value by one when said sheet printing index value exceeds a predetermined value;

displaying, via said display means, said exchange message indicating that said process cartridge should be exchanged for a new process cartridge when said sheet printing index value exceeds said predetermined value; and comparing, after said displaying of said exchange message, said first value with said second value, and resetting said sheet printing index value to an initial value when said first value and said second value have a particular relation.

10. The method as claimed in claim 9, further comprising a step of preventing a printing operation when said first value and said second value are not equal.

11. The method as claimed in claim 9, further comprising a step of displaying said exchange message via said display means when said first value and said second value are not equal.

12. The method as claimed in claim 10, further comprising a step of displaying said exchange message via said display means when said first value and said second value are not equal.

13. The method as claimed in claim 9, wherein said first value equals said second value in said comparing step in response to said process cartridge having been exchanged with said new process cartridge.

14. The method as claimed in claim 12, wherein said first value equals said second value in said comparing step in response to said process cartridge having been exchanged with said new process cartridge.

15. A method for displaying an exchange message for a process cartridge installed within a body of an image forming apparatus, comprising the steps of:

incrementing a sheet printing index value representative of a number of printed sheets that have been generated by said process cartridge by one after each one of said printed sheets is generated by said process cartridge, said sheet printing index value being stored within a video controller of said image forming apparatus;

incrementing a first value stored within said process cartridge by one when said sheet printing index value exceeds a predetermined value;

displaying, via display means, said exchange message indicating that said process cartridge should be exchanged for a new process cartridge when said sheet printing index value exceeds said predetermined value; and comparing said first value with a second value stored within said video controller, and resetting said sheet printing index value to an initial value when said first value and said second value are equal.

16. The method as claimed in claim 15, further comprised of preventing a printing operation and continuing to display said exchange message when said first value and said second value are not equal.

17. The method as claimed in claim 15, wherein said first value equals said second value in said comparing step in response to said process cartridge having been exchanged with said new process cartridge.

18. The method as claimed in claim 16, wherein said first value equals said second value in said comparing step in response to said process cartridge having been exchanged with said new process cartridge.

* * * * *